United States Patent [19]

Weiss

[11] Patent Number: 4,473,373

[45] Date of Patent: Sep. 25, 1984

[54] METHOD OF LAUNDERING AND DELIVERING LINENS

[75] Inventor: Sidney M. Weiss, Greenwich, Conn.

[73] Assignee: Sleep-Knit Corporation, New York, N.Y.

[21] Appl. No.: 496,580

[22] Filed: May 20, 1983

[51] Int. Cl.[3] ..... D06F 35/00; B07C 7/00

[52] U.S. Cl. ..... 8/137; 209/702; 209/937; 383/102; 383/117

[58] Field of Search ..... 209/702, 703, 705, 933, 209/937, 942, 3.1, 3.2, 3.3, 1, 704; 414/786, 13; 8/137; 150/1; 134/25.4; 383/102, 117

[56] References Cited

U.S. PATENT DOCUMENTS

| | | | |
|---|---|---|---|
| 2,015,119 | 9/1935 | McEwen | 383/117 |
| 2,362,683 | 11/1944 | Weinberg | 209/3.3 |
| 2,426,843 | 9/1947 | Phair et al. | 150/1 |
| 3,415,372 | 12/1968 | Drace | 209/937 |
| 3,789,441 | 2/1974 | Weiss | 5/334 |
| 3,857,139 | 12/1974 | Turner | 383/71 |
| 4,308,626 | 1/1982 | Weiss | 5/485 |

*Primary Examiner*—David A. Scherbel
*Assistant Examiner*—Donald Hajec
*Attorney, Agent, or Firm*—Brumbaugh, Graves, Donohue & Raymond

[57] ABSTRACT

A method for linen handling in a hospital or similar institutions uses non-iron sheets with color coded thread and corresponding color net containers to simplify and facilitate handling and distribution of linens. A daily bed care unit has a set of linens for a complete bed change. In one embodiment, essentially all transport and laundering of linens takes place in net containers.

12 Claims, 5 Drawing Figures

METHOD OF LAUNDERING AND DELIVERING LINENS

This invention relates to a method of laundering and delivering institutional linens, including sheets, pillowcases, towels, washcloths and patient gowns.

For more than fifty years the focus of the institutional laundry has been on sorting, washing, conditioning, separating, ironing, folding and stacking woven linens. These linens were first made of 100 percent cotton, and in recent years are made of polyester/cotton blends. The use of woven linens necessitated the employment of a flatwork ironer and its attendant folder, since both are required for proper processing. The polyester/cotton blend woven linens, which the homemaker need not iron, must be sent over the flatwork ironer and through the folder in a commercial laundry. Normally, four to six persons are required to operate the flatwork ironer and the attendant folder. In addition, two sorters, and frequently as many as four, are required to do the separating and sorting of the linens. Moreover, fitted sheets are difficult to process on flatwork ironers and through folders and, therefore, must often be dried separately and hand folded. The resulting product is not attractive since it is not wrinkle-free. Further, the processing in not cost-efficient.

My prior U.S. Pat. Nos. 3,789,441 and 4,308,626 describe fitted bottom sheets and semi-fitted top sheets, respectively. The fabric of these sheets is knitted and is engineered to have two-way stretch. The fabric is made of 100 percent cotton or a polyester/cotton blend or other natural and synthetic blends. The knit fabric is petal-soft and provides linens which are more absorbent and more breathable than woven linens. Most importantly, these knitted linens require no ironing.

It is therefore an object of this invention to provide a new and improved system for laundering and delivering institutional linens which eliminates the need for separating, sorting, ironing, folding and stacking linens on racks.

SUMMARY OF THE INVENTION

In accordance with the present invention there is provided a method for sorting, delivering and using linens in an institution having a plurality of beds. The following are part of the method. Linens are provided, including top sheets, bottom sheets and pillow cases with threads at their seams and hems color coded to indicate the type of each piece. Color coded mesh net delivery containers are also provided. These include net containers corresponding in color to the color coded threads and daily bed care unit net containers having an additional color code. A portion of the linens are sorted into daily bed care units comprising one top sheet, one bottom sheet and one pillow case. These daily bed care units are delivered to a bed containing area of the institution in the daily bed care unit net containers. Remaining linens are sorted into the corresponding color coded net containers, a selected number of linens of the same type being placed in each of the net containers and delivered to the bed containing area. The daily bed care units are used for complete bed linen changes while the linens from the coresponding color coded net containers are used for linen changes requiring less than a complete linen change. In a preferred embodiment, the linens include top and bottom fitted sheets of wrinkle-free, non-iron, knitted fabric. The linens used can also include a patient gown made of similar knitted fabric and having a distinctive color, one garment being placed into each of the daily bed care net containers.

According to various embodiments of the method of the invention soiled linens may be returned to the laundry area of the institution in bulk or may be returned to the laundry area sorted into the color coded net containers. Preferably, the daily bed care units are reassembled following a complete bed linen change into their daily bed care unit net containers and returned for laundering and drying within the containers.

The net delivery containers are preferably provided with a sewn-on identification tag which indicates the subdivision of the institution to which the net containers are assigned. This facilitates the proper flow of linens from the subdivision to the laundry and back to the subdivision in proportion to the amount of linens used. Where all linens are netted in the containers prior to return to the laundry, there is provided a sorting method which includes means for counting the number of linens placed into each of the corresponding color net containers.

For a better understanding of the present invention, together with other and further objects, reference is made to the following description, taken in conjunction with the accompanying drawings, and its scope will be pointed out in the appended claims.

DESCRIPTION OF THE INVENTION

The present invention is a method for handling linen deliveries in an institution, such as a hospital, a nursing home, hotel, motel, prison, ship, military base or a dormitory, wherein there are a large number of bed containing units arranged in subdivisions of the institution.

Figure 4:
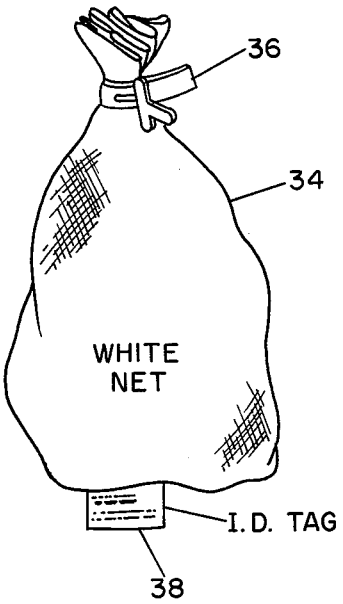
FIG. 4 is an illustration of a net delivery container useful in connection with the method of the present invention.

The method of the present invention makes use of heavy-duty polyester cord mesh net containers of the type illustrated in FIG. 4. The containers have approximately two to four cords to the inch in a net arrangement which permits the laundering of objects within the container. Each container is preferably provided with an identification tag 38 and a heat-proof rubber closure 36. The closure is used to close the container opening during laundering and handling to retain linens in the container 34. The identification tag indicates the contents of the container and the subdivision of the institution to which the linens contained in the net container are assigned. The containers are about 21×33 inches to 24×33 inches in size, depending on the number of items held.

Figure 1:
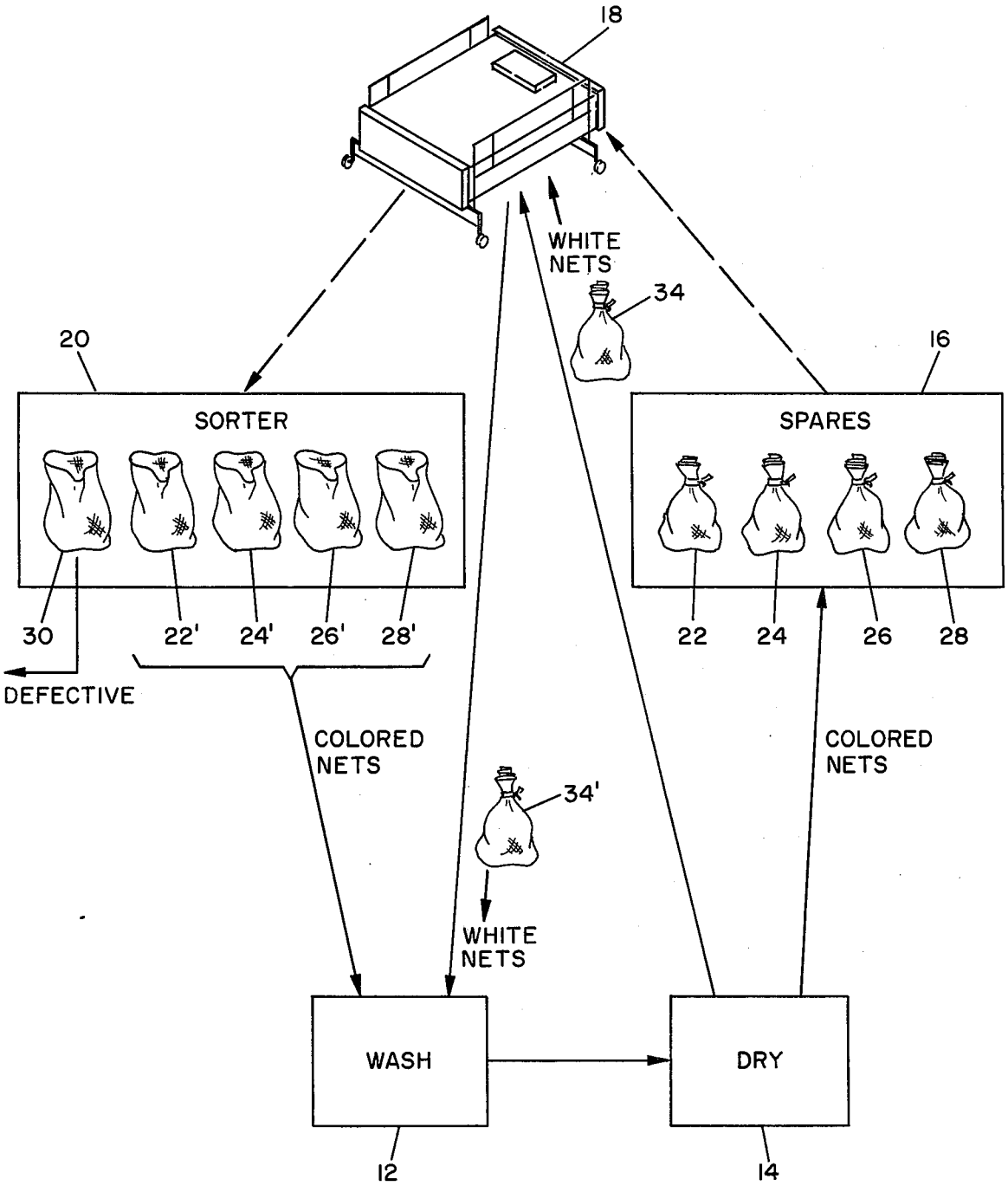
FIG. 1 is a flow diagram illustrating an embodiment of a linen handling method in accordance with the present invention.

The present invention uses a plurality of such containers, each with a different color coding, that is, the cords themselves or only a portion of the cords of each container are provided with a color code to indicate the contents of the container. As illustrated in FIG. 1, there are provided white net containers 34 each of which contains a daily bed care unit consisting of a set of linens for a complete change of a bed. Such a set of linens may include a top sheet, a bottom sheet, and a pillow case. According to the preference of the institution, the unit may also contain a patient gown, and in some cases a towel and wash cloth. In hotel or motel use an additional pillow case may be provided. The sheets, pillow case and patient gown are preferably made of cotton or cotton/polyester blend knit fabric, but such fabrics should not be co-mingled as to fiber content so that a compatible laundering regimen can be established. These fabrics can be laundered and used without ironing or folding and consequently are capable of being satisfactorily laundered while contained in the net container. Where a wash cloth and towel are provided, they may also be made of a knit terry material. Suitable sheets for this method include those described in my prior patents referenced above.

In addition to the white daily bed care net containers 34, each containing a complete bed linen unit, there are provided gold net containers 22, each containing 4 bottom fitted sheets, orange net containers 24, each containing 4 top sheets, blue and white net containers 26, each containing 12 pillow cases and blue net containers 28 each containing 6 night gowns. Red and white net containers may also be provided, each containing 12 towels and 12 wash cloths. These nets are not illustrated in the figures. It will be recognized that the individual colors of the net containers may be changed according to the preference of the user of the system.

The sheets and pillow cases used in connection with the method of the present invention are sewn with a thread at the seams and hems which is color coded according to the type of linen. Accordingly, bottom sheets are provided with gold thread. Top sheets are provided with orange thread. Pillow cases are provided with white thread. Patient gowns are made with distinctive fabric color or design, such as a blue print. These colors facilitate sorting of the articles into the various net containers and identification during the handling of the linens.

Three embodiments of the method of the present invention, which will be described, all use basically the same materials described above, that is, color coded net containers, and color coded linens. In addition to the previously mentioned color coded net containers, the method also uses a green net container for receiving unacceptable linens, such as those which arrive at a bed containing area in a torn or stained condition. Other color nets may be provided for special items, such as draw sheets, basinette sheets, crib sheets, stretcher sheets or the like.

FIG. 1 illustrates the flow of linens for a first embodiment of the present invention. All of the flow diagrams of FIGS. 1, 2 and 3 make use of solid flow lines to indicate the movement of linens in their net containers. The flow diagrams make use of dotted lines to indicate the movement of linens outside of the net containers.

In the FIG. 1 embodiment of the method of the invention, linens are sorted initially into daily bed care units which are inserted into white net containers 34. Additional linens are sorted into corresponding colored net containers 22, 24, 26 and 28. The daily bed care units in the white net containers 34 are used in providing a complete daily bed change of a bed unit 18. The white net containers are delivered intact with their contents to the bed, and when the daily bed change is made, the soiled linens taken from the bed are placed back into the white net containers so that the white net containers contain again a complete linen unit which, after sealing of closure 36, is returned to the laundry where, without usual sorting or inspection, it undergoes washing in washer 12 and drying in dryer 14 for return to the subdivision of the institution. By use of the identification tags 38 contained on the net containers, the linens are always returned to the same subdivision. Accordingly, the flow of linens to the subdivision is directly related to the amount of linens used in that subdivision, so that linens get distributed to the subdivisions where they are needed. The net containers themselves may be stored at the bed or linen room when emptied of their linens. Alternatively, soiled linens taken from the bed may be returned to the container from which fresh linens have been taken. In either case, the linens remain in the white net container through the entire washing, drying and handling cycle, so that there is no requirement for manual assembly by nurses of the linens for the daily bed change.

In the event it becomes necessary to change linens without a complete bed change, for example, if a bottom sheet becomes soiled, or a second pillow case is needed, the nurse or maid can remove a replacement from the container 22 or 26 stored in the linen area or cart 16 of the subdivision and use it as required. The soiled sheet or extra pillow case is returned to a soiled linen sorting area 20 where it is placed within a corresponding color net container 22' or 26' for return to the laundry for processing.

The laundry sorting area 20 includes net containers corresponding in colors to the color coded linens for sorting bottom sheets, top sheets, pillow cases and patient gowns into their appropriate net containers. It may also contain an additional green net container 30, for collecting linens which have become damaged and unusable. These linens can be later repaired or discarded as appropriate.

The replacement bottom sheet, which has been provided from the spare laundry area 16 to the bed 18 will return to the laundry on the next complete bed change in white container 34'. According to the method as illustrated in FIG. 1, all linen going to and from the laundry is sorted into appropriate net containers, and accordingly, the handling in the laundry is minimized.

The embodiment of the method illustrated and described with respect to FIG. 1 provides for the return of all soiled linens to the laundry in the mesh net containers. The packaging and delivery aspects of the method substantially simplifies laundry operations by eliminating all labor intensive operations such as ironing, folding, opening, shaking, sorting, stretching and stacking operations usually carried out in the laundry. Flow of linens is automatically maintained to the subdivisions at which usage is currently required, since the identification tags on the net containers provide for a directed flow of the processed linens.

Figure 5:
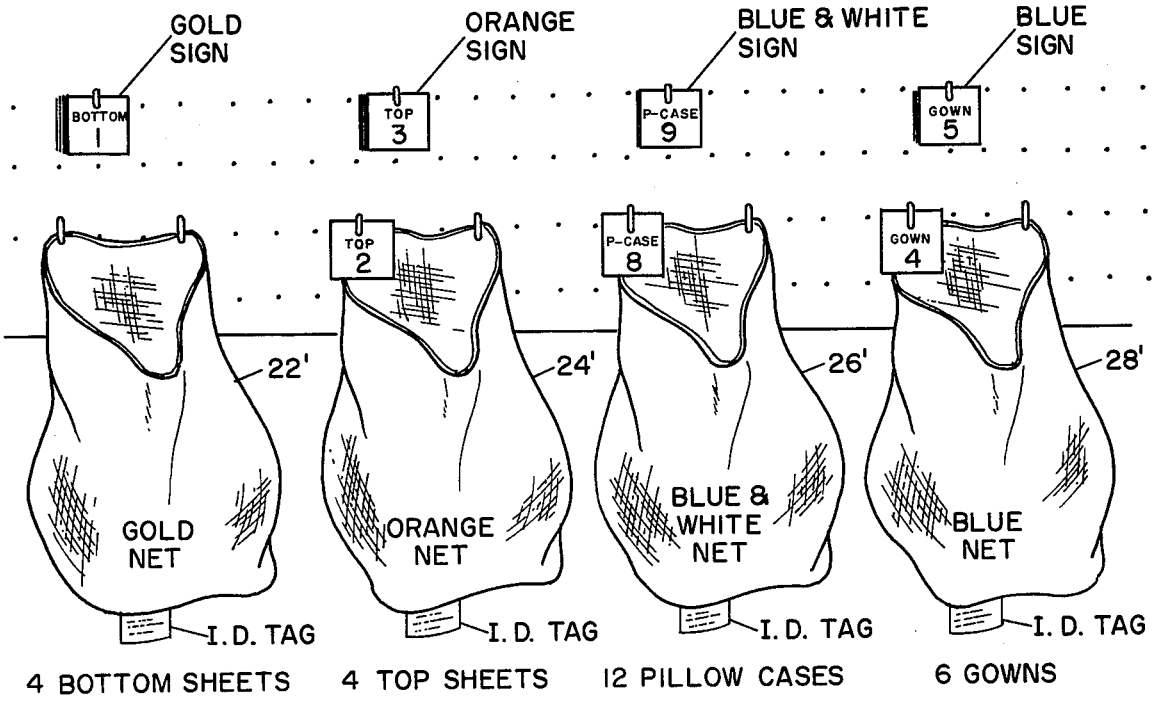
FIG. 5 is an illustration of a sorting and counting arrangement useful in connection with the FIG. 1 embodiment of the method of the present invention.

FIG. 5 illustrates a sorting arrangement for the method of FIG. 1. As illustrated, each of the net containers 22', 24', 26' and 28' is arranged on hooks and provided with counting means for keeping track of the number of units in each of the net containers. When a sheet or pillow case is placed in one of the net containers, a counting card is taken from the top most hook and placed on the hook holding the net container. This indicates the number of units in the net container. Preferably the counting cards are colored the same as the net containers for easy identification. Tags are also provided on the color coded net containers for use in returning laundry from the laundry area of the hospital to the ward from which the linens originated. When a net container contains the appropriate number of items, the tags for counting the items are exhausted and there is a signal for use of an additional net container and sealing of the net container which contains the full number of units.

Figure 2:
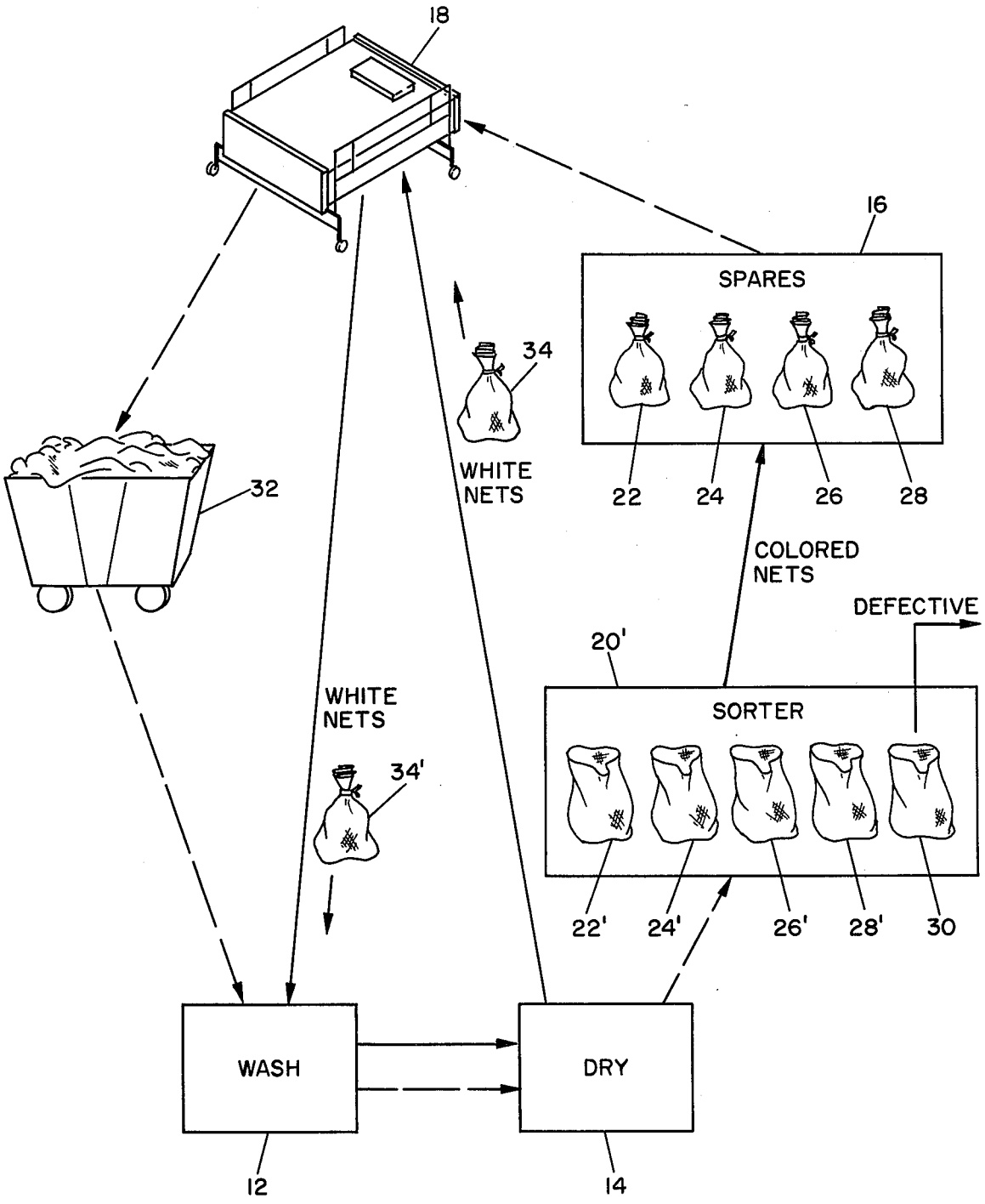
FIG. 2 is a flow diagram illustrating another embodiment of the method of the present invention.

FIG. 2 illustrates a second embodiment of the invention wherein the sorting of linen is done in the laundry area, rather than in the bed containing unit. In the embodiment illustrated in FIG. 2, the daily bed care units contained in white net container 34 are handled in the identical manner to the embodiment of FIG. 1. In the FIG. 2 embodiment, the integrity of the daily bed care units is maintained simplifying the processing and handling of approximately 75% of the linen requirements of a typical hospital, and a higher percentage for other institutions. Following washing and drying, sorting is carried out using a sorting device 20' or other sorting arrangement. This sorting is done in the laundry area by laundry personnel for return of the color coded net containers to the linen area 16 of the bed containing unit.

The embodiment of FIG. 2 eliminates the need for all ironing and folding of linens in the laundry and approximately 75% of the opening, sorting and handling of individual linens.

Figure 3:
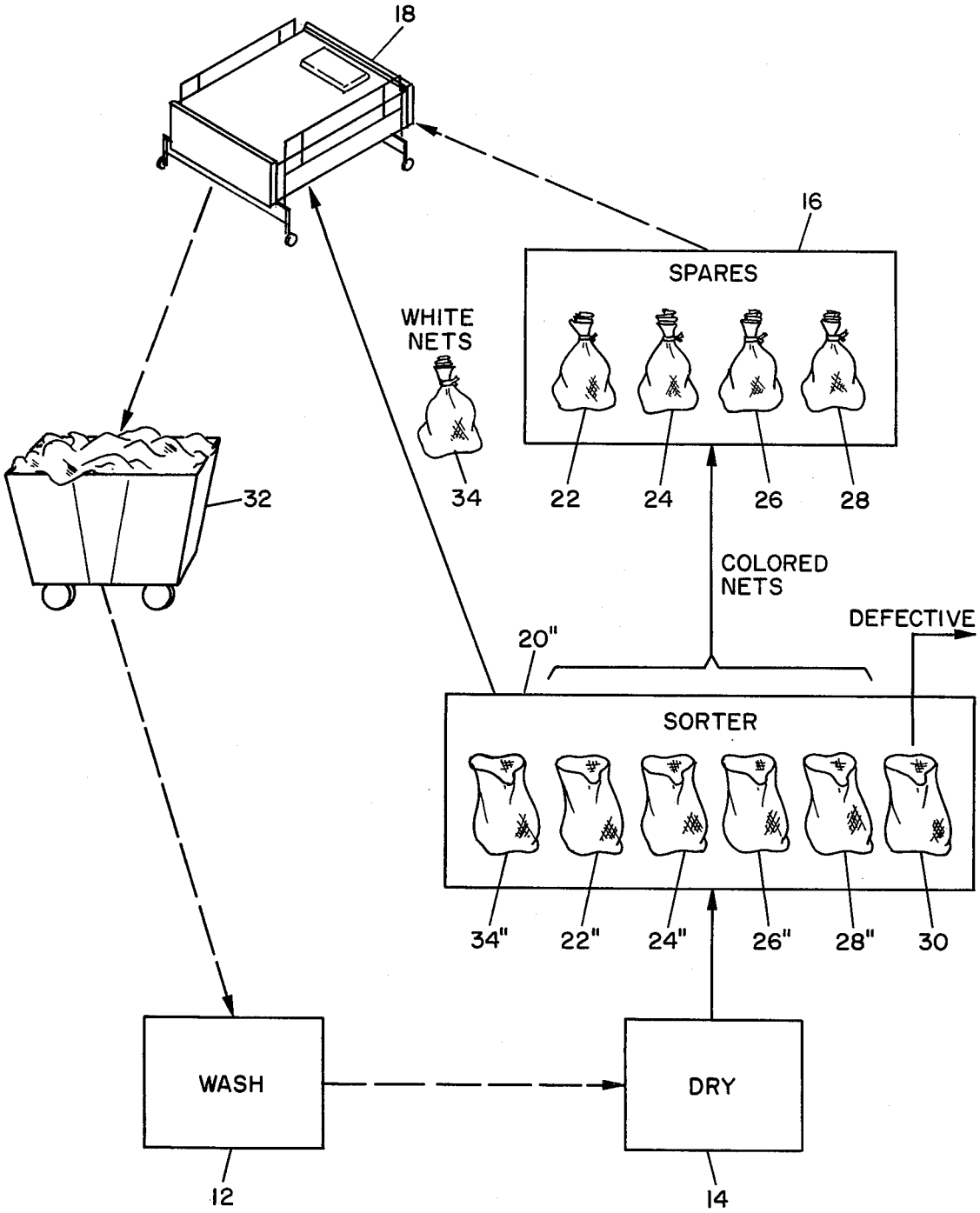
FIG. 3 is a flow diagram illustrating a third embodiment of the method of the present invention.

In a still further embodiment of the invention which is illustrated in FIG. 3, all laundry is returned to the laundry area with the empty mesh net containers in the usual prescribed manner, such as a bulk laundry handling device 32 or via laundry chutes. Following washing and drying, the linens are sorted into both the color coded net containers and the daily bed care unit white net containers 34.

The embodiment of FIG. 3 eliminates the need for all ironing and folding of linens and facilitates efficient laundry distribution and handling.

The FIG. 1 embodiment provides the most costefficient handling of linens in the laundry by significantly simplifying the handling by laundry personnel. This embodiment requires in-service training and supervision of nursing personnel to assure the proper handling of linens. A lesser amount of such training is required by the FIG. 2 and FIG. 3 embodiments, which require a greater amount of linen handling by laundry personnel.

Some advantages of the invention become evident from the fact that the wrinkle-free knit fabrics used require no ironing or folding. Thus, it is no longer necessary for an institution to use the flatwork ironers and attendant folders currently used for woven sheets. Savings are thus achieved not only in equipment cost and maintainance, but also in energy and labor. A typical ironer and folder requires the use of four to six operators. In addition, there is less time required for bed changing, since it is unnecessary to take linens from stacks of like linens at the bed containing subdivision of the unit. The method of the present invention also facilitates the use of the fitted top and bottom sheets referred to in my previous patents, which increase efficiency of nursing and maid personnel because of the easier handling in connection with bed making.

Further advantages are realized because the material used in connection with the knit sheets is easier to launder, making possible the use of lower temperature washing formulation (120° F. vs. 160° F.), and shorter laundering time as compared with woven goods. Further, because the linens are lighter in weight (by 40% as compared to woven goods) laundering weight is reduced saving manpower, energy, water, chemicals and equipment maintainance. An obvious further savings results from the elimination of the need for a flat-work ironer and folder and the lowering of the number of personnel necessary for washing, drying, ironing and folding of linens.

In a preferred form the linens are made from 100% cotton knit fabric that is non-allergenic, non-static and non-abrasive to skin. From a patient care point of view, the knitted fabrics are gentle to the skin and tests results indicate a sharp reduction of decubiti (bed sores). The linens are cooler during the summer and warmer during the winter.

Further major cost efficiency arises from the fact that linen accountability is built into the system. In two of the three disclosed embodiments, each subdivision is responsible for returning soiled linens in net containers assigned to that subdivision. This responsibility has resulted in a major reduction in linen pilferage, which is a high-cost element in hospital, health-care and motel operations. In one experimental installation, pilferage was reduced 54%. In another experimental installation pilferage was reduced to 11% from 49%.

While there have been described what are believed to be the preferred embodiments of the present invention, those skilled in the art will recognize that other and further modifications may be made thereto without departing from the spirit of the invention, and it is intended to claim all such changes and modifications that fall within the true scope of the invention.

I claim:

1. A method for sorting, delivering and using linens in an institution having a plurality of beds, comprising the steps of:

providing linens comprising top sheets, bottom sheets and pillow cases having color codes to indicate the type of each piece;

providing color coded mesh net containers, including net containers corresponding in color to said color coded linens and daily bed care unit net containers having an additional color code;

sorting a portion of said linens into daily bed care units comprising one top sheet, one bottom sheet and one pillow case and delivering said daily bed care units to a bed containing area of said institution in said daily bed care unit net containers;

sorting remaining ones of said linens into said corresponding color coded net containers, a selected number of linens of the same type being placed in each of said net containers and delivered to said bed containing area;

using said daily bed care units for complete bed linen changes;

and using linens from said corresponding color coded net containers for linen changes requiring less than a complete bed linen change.

2. A method as specified in claim 1 wherein said step of providing linens comprises providing non-iron linens of knitted fabric.

3. A method as specified in claim 1 wherein said step of providing linens comprises further providing patient gowns having a distinguishing color characteristic, and wherein said step of sorting said linens into said daily bed care units includes sorting one patient gown into each of said daily bed care units.

4. A method for sorting, delivering, laundering and using linens in an institution having a plurality of beds, comprising the steps of:

providing linens comprising top sheets, bottom sheets and pillow cases having color codes to indicate the type of each piece;

providing color coded mesh net containers, including net containers corresponding in color to said color coded linens;

providing a portion of said linens in daily bed care units comprising one top sheet, one bottom sheet and one pillow case in a bed care unit net container having a unique color;

sorting remaining ones of said linens into said corresponding color net containers, a selected number of linens of the same type being placed in each of said net containers and delivered to said bed containing area;

delivering and using said daily bed care units for complete bed linen changes;

returning used bed linen to said daily bed care unit net containers following said complete bed linen changes;

laundering said used bed linens in said daily bed care unit net containers; and using linens from said corresponding color net containers for linen changes requiring less than a complete bed linen change.

5. A method as specified in claim 4 wherein said step of providing net containers further includes providing labels on said net containers, each of said labels having an indication corresponding to a subdivision of said institution, and wherein said step of delivering said daily bed care units comprises delivering said laundered linens in said daily bed care unit net containers to said subdivision.

6. A method as specified in claim 4 wherein said step of providing linens comprises providing non-iron linens of knitted fabric.

7. A method as specified in claim 4 wherein said step of providing linens comprises further providing patient gowns having a distinguishing color characteristic, and wherein said step of providing said linens in daily bed care units includes providing one patient gown in each of said daily bed care units.

8. A method for sorting, delivering, laundering and using linens in an institution having a plurality of beds, comprising the steps of:

providing linens comprising top sheets, bottom sheets and pillow cases having color codes to indicate the type of each piece;

providing color coded mesh net containers, including net containers corresponding in color to said color coded linens and daily bed care unit net containers having an additional color code;

providing a portion of said linens in daily bed care units comprising one top sheet, one bottom sheet and one pillow case in a daily bed care unit net container;

providing the remaining ones of said linens in said corresponding color net containers, a selected number of linens of the same type being placed in each of said net containers;

delivering and using said daily bed care units for complete bed linen changes;

returning used bed linen to said daily bed care unit net containers following said complete bed linen changes;

laundering said used bed linens in said daily bed care unit net containers;

delivering and using linens from said corresponding color net containers for linen changes requiring less than a complete bed linen change;

returning used linens to said corresponding color net containers following said less-than-complete bed linen changes;

and laundering said used linens in said corresponding color net containers.

9. A method as specified in claim 8 wherein said step of providing net containers further includes providing labels on said net containers, said labels having an indication corresponding to a subdivision of said institution, and wherein said steps of delivering comprise delivering said laundered linens in said daily bed care unit net containers and said corresponding color net containers to said subdivision.

10. A method as specified in claim 8 wherein said step of returning used linens to said corresponding color net containers includes the steps of:

providing a linen counting mechanism for counting the number of linens placed in each of said net containers;

providing a new corresponding color net container when said counting mechanism indicates one of said net containers has said selected number of linens.

11. A method as specified in claim 8 wherein said step of providing linens comprises providing non-iron linens of knitted fabric.

12. A method as specified in claim 8 wherein said step of providing linens comprises further providing patient gowns having a distinguishing color characteristic, and wherein said step of providing said linens in said daily bed care units includes providing one patient gown in each of said daily bed care units.

* * * * *